United States Patent [19]

Jeruzal et al.

[11] Patent Number: 5,038,445

[45] Date of Patent: Aug. 13, 1991

[54] REINFORCEMENT CLIP FOR THE CORNER OF A PANEL FLANGE

[75] Inventors: Thomas M. Jeruzal, Brighton; Robert W. Potter, Trenton, both of Mich.

[73] Assignee: Chrysler Corporation, Highland Park, Mich.

[21] Appl. No.: 564,215

[22] Filed: Aug. 8, 1990

[51] Int. Cl.[5] ..... B65D 59/00

[52] U.S. Cl. ..... 24/545; 206/586; 248/345.1

[58] Field of Search ..... 24/545, 546, 547; 248/345.1; 206/586

[56] References Cited

U.S. PATENT DOCUMENTS

| | | | |
|---|---|---|---|
| 3,150,854 | 9/1964 | Jamieson | 248/345.1 |
| 3,446,345 | 5/1969 | Frosoy | 248/345.1 |
| 3,960,354 | 6/1976 | Simikoski | 248/345.1 |
| 4,503,780 | 3/1985 | Apissomian | 248/345.1 |
| 4,742,916 | 5/1988 | Galea | 248/345.1 |
| 4,801,018 | 1/1989 | Wilde | 248/345.1 |

FOREIGN PATENT DOCUMENTS

| | | | |
|---|---|---|---|
| 3701293 | 4/1988 | Fed. Rep. of Germany | 206/586 |

*Primary Examiner*—Victor N. Sakran

*Attorney, Agent, or Firm*—Edward A. Craig

[57] ABSTRACT

A reinforcement clip is provided for the corner of a panel member to prevent damage to the panel member corner during shipment. The panel member includes at least two substantially flat relatively narrow elongated flange portions joined together at one end thereof to define a planar corner with a panel portion extending from the outer edge thereof. Both the panel portions and flange portions are firmly supported by the reinforcement clip.

5 Claims, 1 Drawing Sheet

REINFORCEMENT CLIP FOR THE CORNER OF A PANEL FLANGE

BACKGROUND OF THE INVENTION

1. Field of Invention

A reinforcement clip is provided for the corner of a panel flange which is used, for example, for a large automotive body aperture to prevent damage to the flange corner during shipment thereof.

2. Prior Art

Sheet metal panels are employed for large vehicle body openings, such as the side of a car. Such structures include an edge flange. Damage to the flange corner may occur when such members are transported from a facility where they are manufactured to an assembly plant where they are mounted on vehicles. In this shipping process, the members are subjected to the vibratory motion of highway trailers or railway cars, which are the common means of transport.

When such panel members are mounted on vehicles, they are also subjected to vibratory action caused by vehicle use. However, the panel members at this point in time are firmly mounted in place which has a damping effect on vibration. This is not true when such members are transported as above described. At this point in time, the members are unattached to any other structure, the panel members being packed in various styles of containers or shipping racks. In addition to being subject to such vibration, the panel members, not being supported by vehicle structure, are subject to panel distortion which may occur because of such lack of support.

Such vibration and distortion has resulted in damage to such panel members. The damage is usually not fracturing or breaking of the members but rather a cracking or splitting of panel structure in the areas of the corners. The problem is frequently aggravated by the fact that quite often corner portions of such edging members are cut away in the manufacturing process. When portions of the panel in the area of the corner are cut away, the remaining panel area is considerably reduced thereby making the corner area even more subject to splitting or distortion. If the splitting or distortion is severe enough, the edging member must be rejected for use at an assembly plant thereby resulting in increased costs of manufacture.

In accordance with the present invention, this problem is alleviated by the provision of a reinforcement clip which is mounted in the corner area of such edging members after the members are manufactured, but prior to shipment thereof to an assembly plant. At the assembly plant, the reinforcement clip is removed and the panel member is mounted in the usual way. It has been found in practice that such reinforcement clips greatly reduce damage resulting from the shipment process.

SUMMARY OF THE INVENTION

A reinforcement clip is provided for the corner of a panel member flange. The panel member is used, for example, for a large automotive body aperture. The clip is designed to prevent damage to the panel member corner flange during shipment thereof. The panel member includes at least two substantially flat flange portions joined together at one end thereof to define a planar corner. The flange portions each have an upper surface, a lower surface, an inner edge and an outer edge. The panel portion extends from the flange portions along the outer edges thereof.

The reinforcement clip includes a platform having an upper surface, a lower surface, an outer edge and an inner edge. A downwardly extending outer wall is provided on the outer edge of the platform and a downwardly extending inner wall is provided on the inner edge of the platform. The inner wall has end portions the upper edges of which are spaced from the lower surface of the platform a distance slightly greater than the thickness of the flanges.

An end wall is provided at each end of the platform extending from the outer wall towards the inner wall but terminating short thereof to define a gap therebetween.

The reinforcement clip is receivable on a panel member corner with the panel portion located at the corner pressing against the inner surface of the clip outer wall. The portions of the flanges adjacent to the corner abut against the platform lower surface and thence project over the upper edges of the end portions of the inner wall. The panel extends through the gaps between the end walls and inner wall while pressing against the inner edges of the end walls.

A pair of spaced apart outwardly extending projections are provided on the outer surface of the inner wall. These projections press against the inner edges of the panel flange portions. A pair of spaced apart inwardly extending projections are provided on the inner surface of the outer wall. These projections press against the outer surfaces of the panels.

The reinforcement clip is adapted for use with a panel member wherein the flange portions adjacent the corner have a cutout portion extending from the inner edges thereof towards the outer edges thereof and terminating short of the outer edges. The reinforcement clip has a pair of spaced apart transverse walls on the upper surface of the platform which extend into the cutout and press against the outer edge portions of the cutout portion.

The platform has an extension projecting inwardly from the inner wall. The extension has an upper surface in substantially the same plane as the upper edges of the inner wall end portions to support flange portions. The transverse walls extend onto the upper surface of the platform extension. The reinforcement clip has an angled wall on the platform extension on each end thereof. Each angled wall projects into one of a pair of V-shaped notches which extend from the inner edges of flange portions to the outer edges thereof but terminate short of the outer edges. Each angled wall presses against the edge of a V-shaped notch which is closest to the corner.

IN THE DRAWING

DESCRIPTION OF A PREFERRED EMBODIMENT

Figure 1:
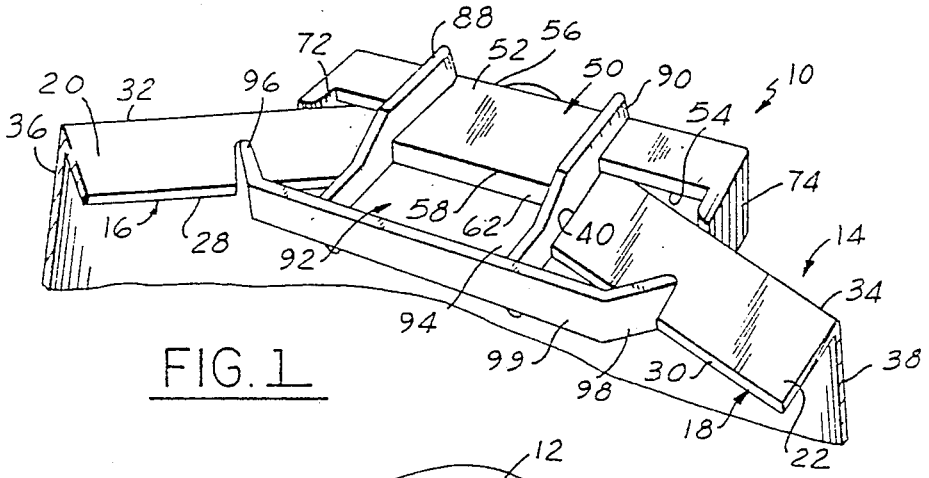
FIG. 1 is a top plan view in perspective of one embodiment of a reinforcement clip in accordance with the present invention mounted on the corner of a panel member.

Referring to the figures, it will noted that a reinforcement clip 10 is provided for the corner 12 of panel member 14. The panel member 14 is for use on a large body aperture of a vehicle such as a side wall panel for the side of a vehicle body. The panel member 14 includes at least two substantially flat relatively narrow elongated flange portions 16, 18. The flange portions 16, 18 are joined together at one end to define a planar corner, that is, a corner wherein the planes of the flange portions coincide. The flange portions each have an upper surface 20, 22, a lower surface 24, 26, an inner edge 28, 30 and an outer edge 32, 34. The flange portions 16, 18 may be joined together at the corner 12 in other than a right angle configuration. The angle depends upon whatever angle is formed by the aperture for which the panel member 14 is adapted to be used.

A panel 36, 38 extends from the flange portions along the outer edges 32, 34 thereof. The panel member 14 is usually fabricated of sheet metal.

Figure 2:
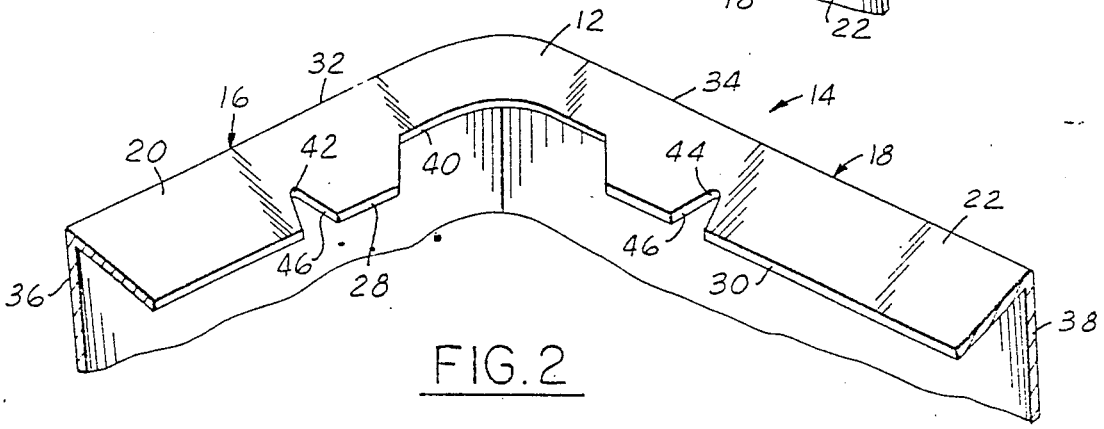
FIG. 2 is a view in perspective of a panel member.
Figure 3:
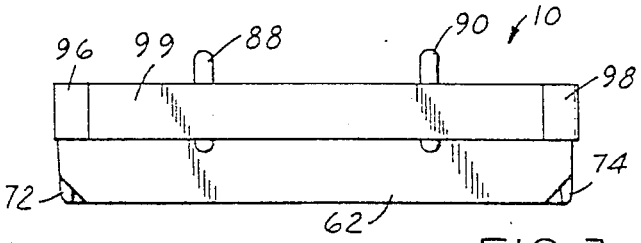
FIG. 3 is a front elevational view of the reinforcement clip.

As will be noted in FIG. 2, a cutout portion 40 extends from the inner edges 28, 30 of the flange portions 16, 18 but terminates short of the outer edges 32, 34. Each flange portion 16, 18 has a V-shaped notch 42, 44 extending from the inner edges 28, 30 towards the outer edges 32, 34 but terminating short thereof. Each V-shaped notch 42, 44 has an edge 46, 48 closest to the corner 12 of the panel member 14.

Figure 5:
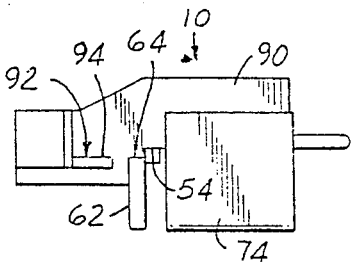
FIG. 5 is an elevational view of the left end of the reinforcement clip as illustrated in FIG. 3.

The reinforcement clip 10 comprises a platform 50 having an upper surface 52, a lower surface 54, an outer edge 56 and an inner edge 58. A downwardly extending outer wall 60 is provided on the outer edge 56 of the platform and a downwardly extending inner wall 62 is provided on the inner edge 58 of the platform. The upper edge 64 of inner wall 62 is spaced from the lower surface 54 of the platform 50, as will be noted in FIG. 5. The spacing distance is slightly greater than the thickness of the flange portions 16, 18 of the panel member 14.

An end wall 72, 74 is provided at each end of the platform. The end walls 72, 74 extend from the outer wall 60 towards the inner wall 62 but terminate short thereof to define a gap therebetween.

A pair of spaced apart outwardly extending projections 80, 82 are provided on the outer surface of the inner wall 62. Another pair of spaced apart inwardly extending projections 84, 86 are provided on the inner surface of the outer wall 60. A pair of spaced apart transverse walls 88, 90 are provided on the upper surface 2 of the platform 50. The platform 50 has an extension 2 projecting inwardly from the inner wall 62. The extension 92 has an upper surface 94 in substantially the same plane as the upper edge 64 of the inner wall 62. The transverse walls 88, 90 extend onto the upper surface 94 of the platform extension 92. An angled wall 96, 98 is provided on the platform extension 92 at each end thereof. The walls 96, 98 are connected by a wall 99.

Figure 4:
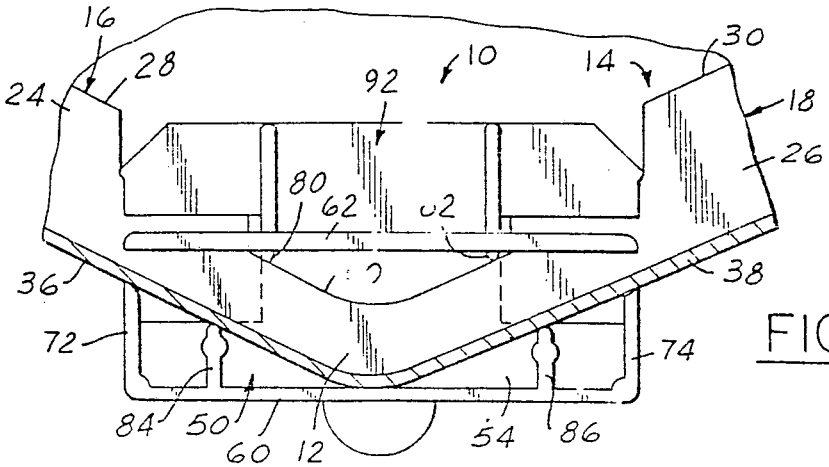
FIG. 4 is a bottom plan view of the reinforcement clip shown mounted on the corner of a panel member.

As will be noted in FIGS. 1 and 4, the reinforcement clip 10 is mounted on the corner 12 of the panel member 14. This may be accomplished by tilting the clip 10 with respect to the panel member. When mounted, the portions of the panels 36, 38 located at the corner 12 press against the inner surface of the outer wall 60, the sections of the panel flange portions 16, 18 adjacent the corner 12 abut against the platform lower surface 54 and thence project over the upper edge 64 of the end portions of the inner wall 62, the panels 36, 38 extend through the gaps between the end walls 72, 74 and inner wall 62 while pressing against the inner edges of the end walls 72, 74, projections 80, 82 press against the inner edges of the flange cutout portion 40, the projections 84, 86 press against the outer surfaces of the panels 36, 38, the transverse walls 88, 90 extend into the cutout portion 40 and press against the outer edge portions of the cutout portion, sections of the flange portions 16, 18 are supported on the platform extension 92, and the angled walls 96, 98 project into the V-shaped notches 42, 44 and press against the edges 46, 48 which are closest to the corner 12.

As will be appreciated, the many points of contact and support provided by the above-described reinforcement clip serve to firmly reinforce the corner 12 of the panel member 14 and prevent the damage heretofore experienced with unreinforced corners. In describing the reinforcement clip 10 and panel member 14, reference has been made to upper and lower and inner and outer relationships. It is to be appreciated that such description is for the purpose of illustration only and not of limitation.

I claim:

1. A reinforcement clip for the corner of a panel flange of a panel member to prevent damage thereto during shipment thereof, the panel member including at least two substantially flat relatively narrow elongated flange portions joined together at one end thereof to define a planar corner, said flange portions each having an upper surface, a lower surface, an inner edge and an outer edge, a panel portion extending from the flange portions along the edges thereof; the reinforcement clip comprising a platform having an upper surface, a lower surface, an outer edge and an inner edge, a downwardly extending outer wall provided on the outer edge of the platform and a downwardly extending inner wall provided on the inner edge of the platform, the inner wall having end portions the upper edges of which are spaced from the lower surface of the platform a distance slightly greater than the thickness of the flange portions of the panel member, an end wall at each end of the platform extending from the outer wall towards the inner wall but terminating short thereof to define a gap therebetween, the reinforcement clip being receivable on a panel member corner with the panel portion located at the corner pressing against the inner surface of said clip outer wall, the sections of the flange portions adjacent the corner abutting against the platform lower surface and thence projecting over the upper edges of the end portions of the inner wall, a pair of spaced apart outwardly extending projections provided on the outer surface of said inner wall, said projections pressing against the inner edges of the flange portions of a panel member upon which the reinforcement clip is received, a pair of spaced apart inwardly extending projections provided on the inner surface of said outer wall, said lastmentioned projections pressing against the outer surfaces of the panel portion of a panel member upon which the reinforcement clip is received, and the panel portion extending through the gaps between the end walls and inner wall while pressing against the inner edges of the end walls.

2. A reinforcement clip as defined in claim 1, wherein the reinforcement clip is adapted for use with a panel member as defined and further wherein the flange portions adjacent the corner have a cutout portion extending from the inner edges thereof towards the outer edges thereof but terminating short of the outer edges, the reinforcement clip having a pair of spaced apart transverse walls on the upper surface of the platform, said transverse walls extending into the cutout and pressing against the outer edge portions of the cutout portion of a panel member upon which the reinforcement clip is received.

3. A reinforcement clip as defined in claim 2, wherein the platform has an extension projecting inwardly from the inner wall, the extension having an upper surface in substantially the same plane as the upper edges of the inner wall end portions to support flange portions of a panel member upon which the reinforcement clip is received.

4. A reinforcement clip as defined in claim 3, wherein said transverse walls extend onto the upper surface of the platform extension.

5. A reinforcement clip as defined in claim 4, wherein the reinforcement clip is adapted for use with a panel member as defined and further wherein the flange portions adjacent the cutout each have a V-shaped notch extending from the inner edges thereof towards the outer edges thereof but terminating short of the outer edges, the reinforcement clip having an angled wall on the platform extension at each end thereof, each angled wall projecting into one of the V-shaped notches and pressing against the edge thereof closest to the corner of a panel member upon which the reinforcement clip is received.

* * * * *